United States Patent [19]

Meyers et al.

[11] 4,054,241

[45] Oct. 18, 1977

[54] TAPERED OCTAGONAL TRAY

[75] Inventors: George Leroy Meyers, Menasha; David Charles Mueller; Edward Thayer Elliott, both of Neenah, all of Wis.

[73] Assignee: American Can Company, Greenwich, Conn.

[21] Appl. No.: 691,879

[22] Filed: June 1, 1976

[51] Int. Cl.[2] ..... B65D 5/28

[52] U.S. Cl. ..... 229/32; 229/41 B; 229/41 C

[58] Field of Search ..... 229/32, DIG. 11, 35, 229/41 C, 34, 41 B

[56] References Cited

U.S. PATENT DOCUMENTS

| | | | |
|---|---|---|---|
| 1,451,963 | 4/1923 | Scruby | 229/32 |
| 1,883,323 | 10/1932 | Andrews | 229/32 |
| 1,894,209 | 1/1933 | Wikstrom | 229/32 |
| 2,751,138 | 6/1956 | Laver | 229/32 |
| 3,447,672 | 6/1969 | Bailey et al. | 229/32 |
| 3,550,835 | 12/1970 | Persson | 229/32 |

*Primary Examiner*—William Price
*Assistant Examiner*—Joseph M. Moy
*Attorney, Agent, or Firm*—Robert P. Auber; Ira S. Dorman; John M. Winter

[57] ABSTRACT

A nestable octagonal tray having tapered, glued side walls of low height. The tray has an octagonal bottom panel, four trapezoidal side walls each attached at its shorter parallel edge to the bottom panel, four trapezoidal side flaps each attached at its longer parallel edge to the bottom panel, and eight substantially rectangular glue flaps each attached along its base to one of the non-parallel sides of the trapezoidal side walls. The side flaps and glue flaps are adhered in overlapping relation.

5 Claims, 2 Drawing Figures

TAPERED OCTAGONAL TRAY

BACKGROUND OF THE INVENTION

This invention relates to tapered octagonal paperboard trays and blanks therefor.

Nestable, foil-lined paperboard trays are gaining acceptance in the packaging industry particularly for baked goods and the like due to their significantly lower cost than solid aluminum trays.

As the wall height of known paperboard octagonal trays is decreased, the overlap area available for adhesive bonding of the glue flaps to the side wall area adjacent the corners decreases drastically. This problem has been critical in foil-lined trays of fractional inch wall height in that it often results in adhesive bonding failures of the glue flaps.

SUMMARY OF THE INVENTION

The paperboard blank of this invention forms glue flaps of very adequate adhesive bonding area even in trays of fractional inch wall height from the square area of paperboard required for economical blank layout.

Generally rectangular glue flaps are hinged to the nonparallel sides of the trapezoidal side walls and the outer edge of each glue flap is cut back from the top side of the trapezoidal side wall to which it connects so that the upper edge of the glue flap extends substantially along the top edge of the side flap to which the glue flap is adhered when the tray is set up.

In blank form, the upper edge of each glue flap forms an internal angle of more than 180° with the score line forming the bottom side of the side wall to which the flap is connected to maximize the overlapping adhesive bonding areas when the tray is set up.

Further objects, features and advantages of the invention will be apparent from the following detailed description taken in conjuction with the accompanying drawing showing a preferred embodiment for exemplification.

DESCRIPTION OF A PREFERRED EMBODIMENT

Figure 1:
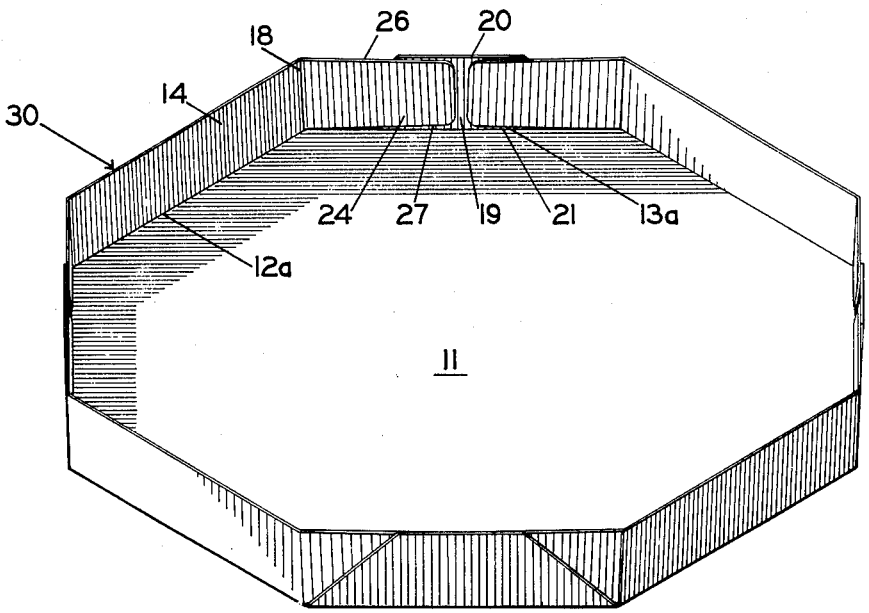
FIG. 1 is an isometric view of the tray embodying the principles of the invention.
Figure 2:
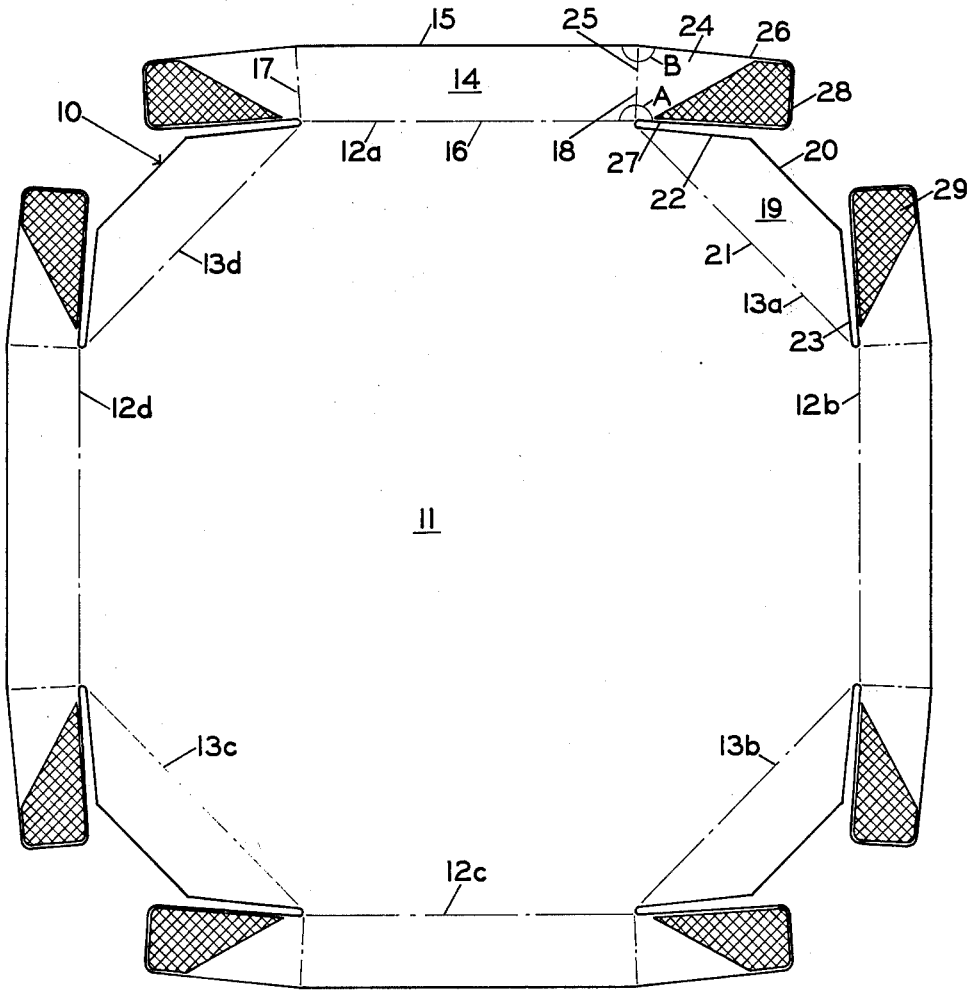
FIG. 2 is a plan view of a paperboard blank for forming the tray shown in FIG. 1.

Referring now more particularly to the drawings wherein like numerals refer to like parts in both views, the paperboard blank 10, as shown in FIG. 2, is suitably cut and scored to provide a low-walled, nestable, octagonal tray 30 shown in FIG. 1.

An octagonal bottom panel 11 is defined by a first set of four score lines 12*a, b, c* and *d* and a second set of four score lines 13*a, b, c* and *d*. Four trapezoidal side walls, such as shown at 14, each have parallel top and bottom sides 15 and 16, respectively, and a pair of nonparallel sides defined by score lines 17 and 18. The top side 15 is longer than the bottom side 16 at which the side wall 14 is attached to the bottom panel 11 along score line 12*a*.

Four trapezoidal side flaps such as shown at 19 each have parallel upper and base edges, 20 and 21, respectively, and a pair of nonparallel edges 22 and 23. The base edge 21 is substantially longer than upper edge 20 whereby the sides 22 and 23 lie inside of extensions of score line 12*a* and 12*b*.

The four trapezoidal side walls 14 and the four trapezoidal side flaps 19 are alternately disposed about the periphery of the bottom panel 11.

The blank also has eight generally rectangular identical glue flaps, one being shown at 24 having a base 25 formed by the score line 18, an outer edge 26, an inner edge 27 and an end 28. Each of the glue flaps such as 24 is attached to the side of a side wall such as 14 along a score line such as 18.

Each of the glue flaps 24 has a pattern of heat sealable adhesive 29 as shown in FIG. 2.

To form the tray 30 the four side walls 14 are folded upwardly about score lines 12*a–d* and the eight glue flaps 24 are then folded inwardly about their base score lines. The side flaps 19 are folded upwardly about score lines 13*a–d* and heat sealed to the outside of the glue flaps as shown in FIG. 1.

The glue flaps 24 while being generally rectangular have a particular configuration and orientation important to this invention. The inner edge 27 of each of the glue flaps forms an internal angle, such as depicted at A in FIG. 2, greater than 180° with the score line 12*a* forming the bottom side 16 of the side wall 14 to which the glue flap 24 connects. When the tray is set up, as shown in FIG. 1, the inner edge 27 of the glue flap 24 extends substantially along the base edge 21 of the side flap to which the glue flap is adhered to maximize the overlapping adhesive bonding area of the tray. For example, a moderately tapered tray having a wall height of about three quarters of an inch, the angle A might be from about 183° to about 186°.

The outer edge 26 of each of the glue flaps 24 forms an internal angle, such as depicted at B in FIG. 2, less than 180° with the top side 15 of the side wall 14 to which the glue flap connects. When the tray is set up, as shown in FIG. 1, the outer edge 26 of the glue flap extends substantially along the upper edge 20 of the side flap to which the glue flap is adhered. For example, in a moderately tapered tray having a wall height of about three quarters of an inch the angle B might be from about 174° to about 177°.

It should be understood that this invention is not limited to the particular construction herein illustrated and described, but embodies all such modified forms as come within the scope of the following claims.

We claim:

1. An octagonal tray of less than one inch in height made from a one piece paperboard blank, said blank comprising:

a. an octagonal bottom panel having four sides defined by a first set of four score lines and four sides defined by a second set of four lines, b. four trapezoidal side walls each having parallel top and bottom sides and a pair of nonparallel sides, said top sides being longer than said bottom sides, each of said trapezoidal side walls being attached at its bottom side to said bottom panel along one of said first set of score lines, c. four trapezoidal side flaps each having parallel upper and base edges said base edges being longer than said upper edges, each of said trapezoidal side flaps being attached along its base edge to said bottom panel along one of said second set of score lines, d. said trapezoidal side walls and side flaps being alternately disposed about the periphery of said bottom panel, and e. eight generally rectangular glue flaps having a base, an inner edge, and an outer edge, one each of said glue flaps being attached along its base to one each of the nonparallel sides of said side walls along a common fold line.

2. The paperboard blank for forming a tapered octagonal tray as specified in claim 1 wherein the inner edge of each of said glue flaps forms an internal angle greater than 180° with the score line forming the bottom side of the side wall to which the glue flap connects.

3. A tapered octagonal tray of less than one inch in height, comprising:

a. an octagonal bottom panel having four sides defined by a first set of four score lines and four sides defined by a second set of four score lines, b. four trapezoidal side walls each having parallel top and bottom sides and a pair of nonparallel sides, saidtop sides being longer than said bottom sides, each of said trapezoidal side walls being attached at its bottom side to said bottom panel along one of said first set of score lines, c. four trapezoidal side flaps each having parallel upper and base edges said base edges being longer that said upper edges, each of said trapezoidal side flaps being attached along its base edge to said bottom panel along one of said second set of score lines, d. said trapezoidal side walls and side flaps being alternately disposed about the periphery of said bottom panel, and e. eight generally rectangular glue flaps having a base, an inner edge, and an outer edge, one each of said glue flaps being attached along its base to one each of the nonparallel sides of said side walls along a common fold line, two of said glue flaps being overlapped with one of each said side flaps, and each of said common fold lines forming an angle greater than 90° with one of the scored lines of the first set and f. glue means for adhering said glue flaps to the side flaps which they overlap.

4. The tapered octagonal tray as specified in claim 3 wherein the inner edge of each of said glue flaps extends substantially along the score line forming the base edge of the side flap to which the glue flap is adhered to maximize the overlapping adhesive bonding area.

5. The tapered octagonal tray as specified in claim 3 wherein the outer edge of each of said glue flaps extends substantially along the upper edge of the side flap to which it is adhered.

* * * * *